US006115838A

United States Patent [19]

Scholtis et al.

[11] Patent Number: 6,115,838

[45] Date of Patent: Sep. 12, 2000

[54] GARMENT FOR PROTECTING ENGLISH-STYLE RIDING BREECHES

[76] Inventors: Donna L. Scholtis, P.O. Box 369, Laury's Station, Pa. 18059; Diane L. Scheirer, 700 View Dr., Walnutport, Pa. 18088

[21] Appl. No.: 09/123,740

[22] Filed: Jul. 28, 1998

[51] Int. Cl.[7] ..... A41D 1/06; A41D 27/12

[52] U.S. Cl. ..... 2/46; 2/79; 2/227

[58] Field of Search ..... 2/46, 79, 227, 2/229, 233

[56] References Cited

U.S. PATENT DOCUMENTS

| | | | |
|---|---|---|---|
| 541,334 | 6/1895 | Roschi . | |
| 552,785 | 1/1896 | Shrier . | |
| 671,059 | 4/1901 | Sanders . | |
| 907,050 | 12/1908 | Hestness . | |
| 1,092,685 | 4/1914 | Wootten | 2/227 |
| 1,771,916 | 7/1930 | Cowen . | |
| 1,885,527 | 11/1932 | Luft . | |
| 1,893,470 | 1/1933 | Emms . | |
| 2,020,984 | 11/1935 | Abelson | 2/227 |
| 2,119,602 | 6/1938 | Roberts et al. . | |
| 2,316,588 | 4/1943 | Isaacs . | |
| 2,967,308 | 1/1961 | Freese, Jr. . | |
| 3,334,357 | 8/1967 | Stults . | |
| 4,006,494 | 2/1977 | Knoppel | 2/227 |
| 4,055,853 | 11/1977 | Argento et al. . | |
| 4,561,124 | 12/1985 | Thompson . | |
| 4,622,697 | 11/1986 | Tajima . | |
| 4,667,344 | 5/1987 | Cooper, III . | |
| 4,683,509 | 7/1987 | Charron . | |
| 4,700,407 | 10/1987 | Mattila . | |
| 4,843,654 | 7/1989 | March . | |
| 5,033,124 | 7/1991 | Bucalo et al. . | |
| 5,359,731 | 11/1994 | Cavalier . | |
| 5,377,693 | 1/1995 | Loper et al. . | |
| 5,642,526 | 7/1997 | Thompson . | |

FOREIGN PATENT DOCUMENTS

| | | |
|---|---|---|
| 971703 | 7/1975 | Canada . |
| 0072459 | 7/1982 | European Pat. Off. . |
| 21012 | 9/1906 | United Kingdom . |
| 2226943 | 7/1990 | United Kingdom . |

OTHER PUBLICATIONS

Tropical Rider Advertisment, May 5, 1999.

*Primary Examiner*—Bidhu Mohanty
*Attorney, Agent, or Firm*—Richard P. Gilly

[57] ABSTRACT

A protective garment to be worn over English-style, riding breeches has a front pocket specially sized to hold mane braiding or other horse grooming tools therein. The pocket is located high on the garment, such as right below the waistband thereof, and the opening is correspondingly located so that it can be readily accessed by the wearer of the garment even when he or she is mounted on horseback. The garment can also be readily put on over English-riding boots because it has a suitably long slit extending from the leg bottoms toward the waist of the garment. The resulting garment protects the riders underlying breeches from being dirtied by the organic materials typically found at equestrian facilities.

20 Claims, 4 Drawing Sheets

GARMENT FOR PROTECTING ENGLISH-STYLE RIDING BREECHES

FIELD OF THE INVENTION

This invention relates generally to garments worn over other garments, and more particularly, to a protective garment to be worn over English-style, horse-riding breeches.

BACKGROUND OF THE INVENTION

Those who ride in the English-style generally wear English-style riding breeches. Such breeches, as is well known, often have features specifically designed for such riding activities. As breeches are relatively specialized garments, they are often correspondingly expensive. Some riders, consequently, may own only a limited number of English-style riding breeches. For this reason alone, it is often desirable to avoid soiling or otherwise dirtying the breeches when they are being worn, so as not to deplete the rider's limited clean supply.

In any event, an English-style rider often wants to keep his or her breeches clean for any number of additional reasons. For example, the rider may be participating in a horse show class, competition, or similar event. If such events are either attended by others, judged, or both, the rider will naturally wish to present a polished appearance. The cleanliness of the rider's breeches is thus important under such circumstances.

Unfortunately, it is not always easy to keep one's breeches clean before horse show classes, competitions or other judged or public events. Dirt, mud, grass, and other organic material are inescapable in equestrian facilities, riding rings, stables, and the like. A horseback rider who comes dressed for a horse show class, competition, or other judged event, cannot help but be exposed to these earthy materials, which in turn may result in dirtying or soiling of the rider's outfit, including the breeches.

Furthermore, the rider is frequently required to either groom or work the horse before class or competition. Such activities, again, are likely to displace dirt or other soiling agents which, upon contact with the breeches, will inevitably soil them. For example, during practice runs, the horse generally kicks up dirt from the riding ring. The resulting particulate, whether dust or larger pieces, sometimes is severe enough to engulf the rider in a dust cloud, but at a minimum, dirt will contact the rider and may spot and soil his or her breeches during such runs.

There is thus a need to protect a rider's breeches from elements which would otherwise make them dirty. The prior art, however, has failed to provide adequate solutions to meet the particular needs of persons desiring to protect their English-style riding breeches from the elements. In particular, while the art has disclosed numerous patentable features on riding breeches themselves, there are scant developments for garments to be worn over such riding breeches.

Generic overgarments, such as raingear and overalls, are ill suited to the particularities of English-riding breeches. An example of such generic overgarments is that shown in Thompson U.S. Pat. No. 5,642,526. A garment suitable for protecting riding breeches must be capable of being put on over English-style riding boots, which extend relatively high on the calf, even by boot standards. More importantly, such boots are notoriously inflexible at the ankle, making it difficult at best for the rider to point the toe to fit through the legs of an overgarment. Overgarments of the current art thus are not structured to allow for passage of an English-riding boot therethrough.

Similarly, it is important for the rider to be able to groom the horse before horse show class, competition, or other events. Overgarments of the prior art, however, fail to provide suitable means for storing grooming tools, including mane braiding tools and the like, as seen in U.S. Pat. No. 4,667,344 to Cooper.

It is important for the legs of garments worn while on horseback to have substantially uniform inner sides. Discontinuities or excessively large inseams on such garments, as opposed to uniformity, will abrade the horse, the rider, or both, during the frequent tight contact between the rider's inner legs and the horse's flanks. As a result, many overgarments of the prior art have bulky or otherwise non-uniform inseams or inner leg portions which would chafe and thus be unsuitable for wearing while on horseback.

Furthermore, the abrasion occurring between the inner sides of the rider's legs and the flanks of the horse would quickly wear out the inner leg portions of typical overgarments. This excessively quick wear generally makes the typical overgarments unsuitable as a long-term solution to the need to keep a rider's underlying riding breeches clean.

There is thus a need to overcome the drawbacks and disadvantages of current art and provide a garment which effectively protects a rider's breeches.

There is a further need to provide such protection and also allow such rider to perform grooming, working, and other equestrian related activities while wearing such overgarment.

There is need for such garment to be easy to don or doff while the rider is fully dressed for horse show class, competition, or other judged events, including while the rider is wearing typical, English-style riding boots.

SUMMARY OF INVENTION

The invention provides a protective garment which is worn over English-style, riding breeches. The garment has a pair of legs which extend down from a waistband. The legs have inner sides which generally contact the sides of the horse during riding, and outer sides located to the outside and opposite the inner side. At least one pocket is defined in the upper portion of the garment, and the pocket has a top edge which is right below the waistband of the garment. It is important for the pocket to be large enough to put mane-braiding and other grooming tools therein. The pocket has a substantially horizontal, reclosable opening which is positioned close enough to the waist band so that the user can access it even when in the crouched or seated position typical of being mounted on a horse. Each of the legs has a reclosable slit which extends upwardly from the bottom and has a length sufficient so that a typical, English-style riding boot can pass through the opening of the bottom and the slit.

In accordance with another aspect of the present invention, the outer sides of the garment have side seams and the pocket extends almost all the way to the side seams on both sides. The slits at the bottom of the legs are located at the side seams, and a zipper is secured along the slit which can be selectively opened and closed so that the riding boots can be passed through the slit. Once the garment has been passed over the riding boots, the bottoms of the legs can then be resecured around the riding boots.

In accordance with still another aspect of the present invention, the garment is sewn from a material which is breathable, lightweight and generally water-resistant. The garment may also have strengthening patches located on the inner sides at the legs of the garment, generally at a location between the waist and the bottom, which would correspond to the insides of the rider's knees, when the garment is being worn.

BRIEF DESCRIPTION OF THE DRAWINGS

For the purpose of illustrating the invention, there is shown in the drawings forms which are presently preferred; it is understood, however, that the invention is not limited to the precise arrangements and instrumentalities shown.

DETAILED DESCRIPTION OF THE PREFERRED EMBODIMENTS

Figure 1:
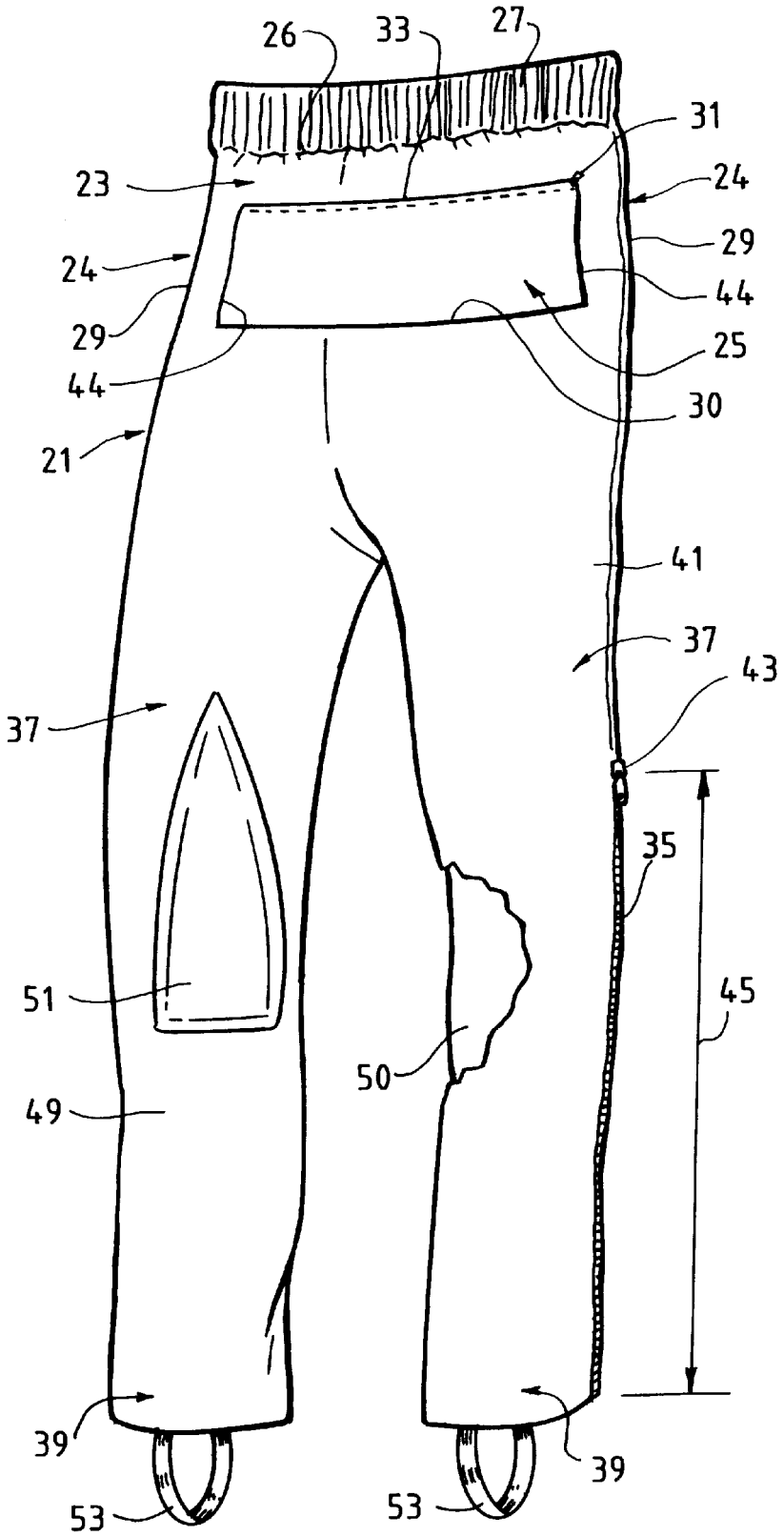
FIG. 1 is a perspective view of a protective garment according to the present invention.
Figure 2:
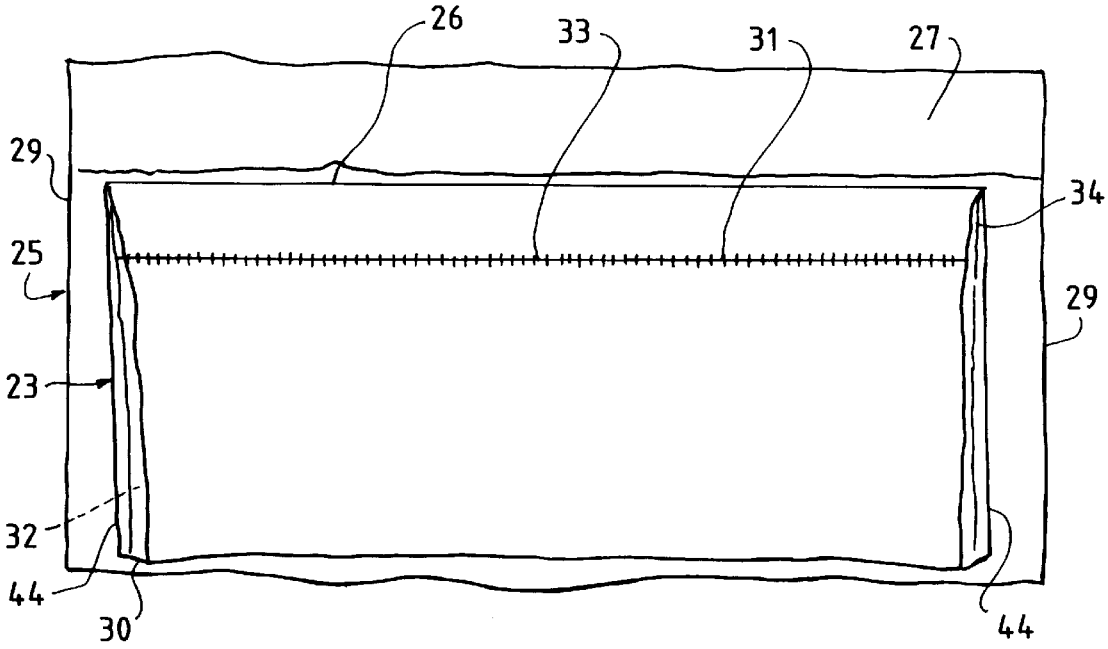
FIG. 2 is a partial, front, elevational view of the upper portions of the legs of the garment according to the present invention.
Figure 3:
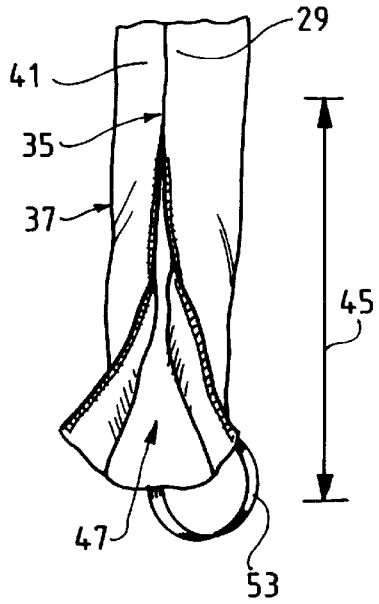
FIG. 3 is a partial, side elevational view of one of the legs of the garment according to the present invention.

Referring now to the above-referenced drawings, and in particular FIGS. 1–3 thereof, a protective garment 21 is designed to be worn over a pair of typical, English-style, riding breeches (50). Although garment 21 is generally pants-like in structure, it has some important, distinguishing features particularly suited for wearing over English-riding breeches.

In particular, a special pocket 23 is defined in the upper portion 25 of the garment. Pocket 23 has a top pocket edge 26 located immediately below waistband 27. Pocket 23 extends downwardly to terminate at a bottom edge 30. Opposite, pocket sides 44 extend between the top and bottom edges of the pocket 23 to define a contained space 32 (FIG. 2) inside pocket 23. Pocket sides 44 are shown in FIG. 2 at inward locations from side seams 29, but the pocket sides may also be defined right at side seams 29 to give pocket 23 greater width and thus increase the corresponding size of contained space 32. Providing pocket 23 with optional, expandable pleats 34 (FIG. 2) further enhances contained space 32 by giving contained space 32 a predetermined "depth" in addition to the length between top and bottom edges and the width between opposite sides 44.

Contained space 32 is wide enough and large enough so that mane braiding and other grooming tools will fit in pocket 23 after they have been inserted through substantially horizontal opening 31.

Opening 31 is reclosable in this embodiment by means of zipper 33. Because the reclosable opening 31 is substantially horizontal and located near waistband 27, the wearer of garment 21 can relatively easily access the contents of pocket 23 even when the wearer is in the crouched or seated position while mounted on the horse. In contrast, access to the more typically located pockets is generally difficult when in the saddle because such seated or crouched position generally compresses the spaces enclosed by typical side pockets.

Another important aspect of the present invention is equipping the legs 37 with reclosable slits 35. The slits 35 are long enough to allow the garment 21 to be put on over the user's feet and legs even when the user is wearing typical, English-style riding boots as discussed in more detail below. Slits 35 extend from respective bottoms 39 of respective legs 37 generally upwardly along the outer sides 41 of the legs 37. Preferably, slits 35 are formed at side seams 29 on outer sides 41, and the slits are reclosable by means of zippers 43 which extend the length of respective slits 35. Slits 35 are in communication with the openings defined by bottoms 39 of legs 37 to define respective openings 47 (FIG. 3). Slits 35 extend a distance 45, which is selected so that a typical, English-style riding boot can be easily inserted through the opening 47

Legs 37 of garment 21 have inner sides 49, one of which is visible in FIG. 1. The inner sides 49 are generally in contact with the flanks of the horse (not shown) during riding. Inner sides 49 are "sandwiched" between the rider's legs and the horse's flanks. Because the rider's legs generally move in relation to the horse's flanks while riding, the material of inner sides 49 shifts in relation thereto. As a result, it is important for inner sides 49 of garment 21 to be constructed of material which is substantially uniform, thereby avoiding surface irregularities which may chafe the rider as a result of movement of inner sides 49 relative to the rider's legs and the flanks of the horse. It is thus preferable to form inner sides 49 without inner seams therein or, at a minimum, with inner seams which are of minimum bulk and thus avoid substantial chafing.

Furthermore, the above-described contact between inner sides 49 and the horse's flanks may cause premature wear of the material at inner sides 49. In particular, back and forth contact between the insides of the rider's knees and the flanks of the horse often results in premature wear at corresponding locations on protective garment 21. It is thus preferable to reinforce inner sides 49 with a patch 51 (one of which is shown in FIG. 1) of reinforcing or strengthening material, such as suede or self-fabric. Patch 51 reduces premature wear of the inner sides 49 of garment 21. One suitable location for patch 51 is at a medial location along legs 37 which would correspond to the inner sides of the rider's knees when the garment 21 is worn.

Still other features of the garment 21 have been designed mindful of the contact between the insides of the rider's legs and the horse's flanks. In particular, the slits 35 and the associated zippers 43 have been carefully located at a position on legs 37 where the slits 35 and zippers 43 do not chafe unduly against the rider's legs while riding. Thus, the slits 35 and zippers 43 are located on the outer sides 41 of garment 21, rather than on the inner sides 49 or the back sides (not shown). Outer sides 41 are unlikely to come into contact with the horse's flanks, and thus slits 35 and zippers 43, when located at outer sides 41, will not chafe the rider's legs (or the horse's flanks).

Garment 21 may optionally include stirrups 53 secured to bottoms 39 of legs 37. In particular, the stirrups 53 have a pair of opposing ends, one of which is secured to a corresponding inner side 49, the other of which is secured to a corresponding outer side 41 at a location in front of or forward of the corresponding slit 35.

Garment 21 can be made from any of a variety of available materials used for overgarments. Preferably, garment 21 is sewn from a material which is breathable, lightweight, durable, wrinkle-free, color-fast, and soil and water-resistant. Suitable materials include various laundered nylons such as two-ply, high count textured nylon 3.4 oz. manufactured under the mark SUPPLEX, multi-ply textured nylon 4.5 oz manufactured under the mark TASLAN, or simple textured nylon 3.3 oz. Garment 21, especially legs 37, may be lined with suitable material having thermally insulative properties such as spun polyester fleece.

The garment can be constructed in a variety of adult and even children's sizes. In the adult sizes, slit 35 is generally not less than about 24 inches in length so that opening 47 can accommodate the relatively stiff, inflexible English-style riding boot. Smaller, children's sizes would have slits 35 which are proportionally smaller.

The pocket 23 generally ranges in width (between opposite sides 44) from about 8 inches for smaller-sized garments to about 10 inches for adult sizes. If sides 44 of pockets 23 coincide with side seams 29 of garment 23, then the width is correspondingly larger, ranging from about 12 inches to about 16 inches. The pocket 23 preferably has a pleat or gusset 34 which, when expanded, gives pocket 23 a depth ranging from about two inches to about 4 inches. The length ranges from about 5 inches to about 7 inches, again depending on the relative size of garment 23. It is sufficient that the length be selected so that items in pocket 23 lying adjacent to bottom edge 30 are accessible even if the wearer is in a crouched position atop the horse. The above dimensions have been found especially suitable for readily accommodating mane-braiding and other grooming tools in pocket 23 without such tools either stressing the garment material or jabbing into the horse or wearer during movement.

One of the many ways in which the garment 21 according to the present invention can be used is now described. The rider first dresses in his or her English riding outfit, including riding breeches and associated English-riding boots. The rider makes sure zippers 43 are opened, preferably to their respective limits to create openings 47 as large as possible at bottoms 39. The rider then puts garment 21 on feet first, so that the boots pass through openings 47. The garment is then pulled over the breeches to protect them from dirt or other soil.

Of course, the garment according to the present invention, can be put on at any point in time, but is preferably put on either before leaving for the equestrian facility or before engaging in any activities at such facility which are likely to soil the breeches.

The rider then proceeds to work the horse, groom the horse, ride the horse, or indulge in any of other associated equestrian activities prior to the horse show class, competition, or other judged event. Once these various preliminary activities have been accomplished by the rider and it is time to start the class or competition, the rider unzips zippers 43, thus opening slits 35 and allowing the rider to readily remove garment 21.

The rider then makes a public appearance with clean breeches, which, it is hoped, will make a positive impression on the public, on the rider's peers, or on any judges, as the case may be. In any event, the breeches protected by garment 21 do not need to be cleaned as often and can thus be worn on more occasions before cleaning.

Figure 4:
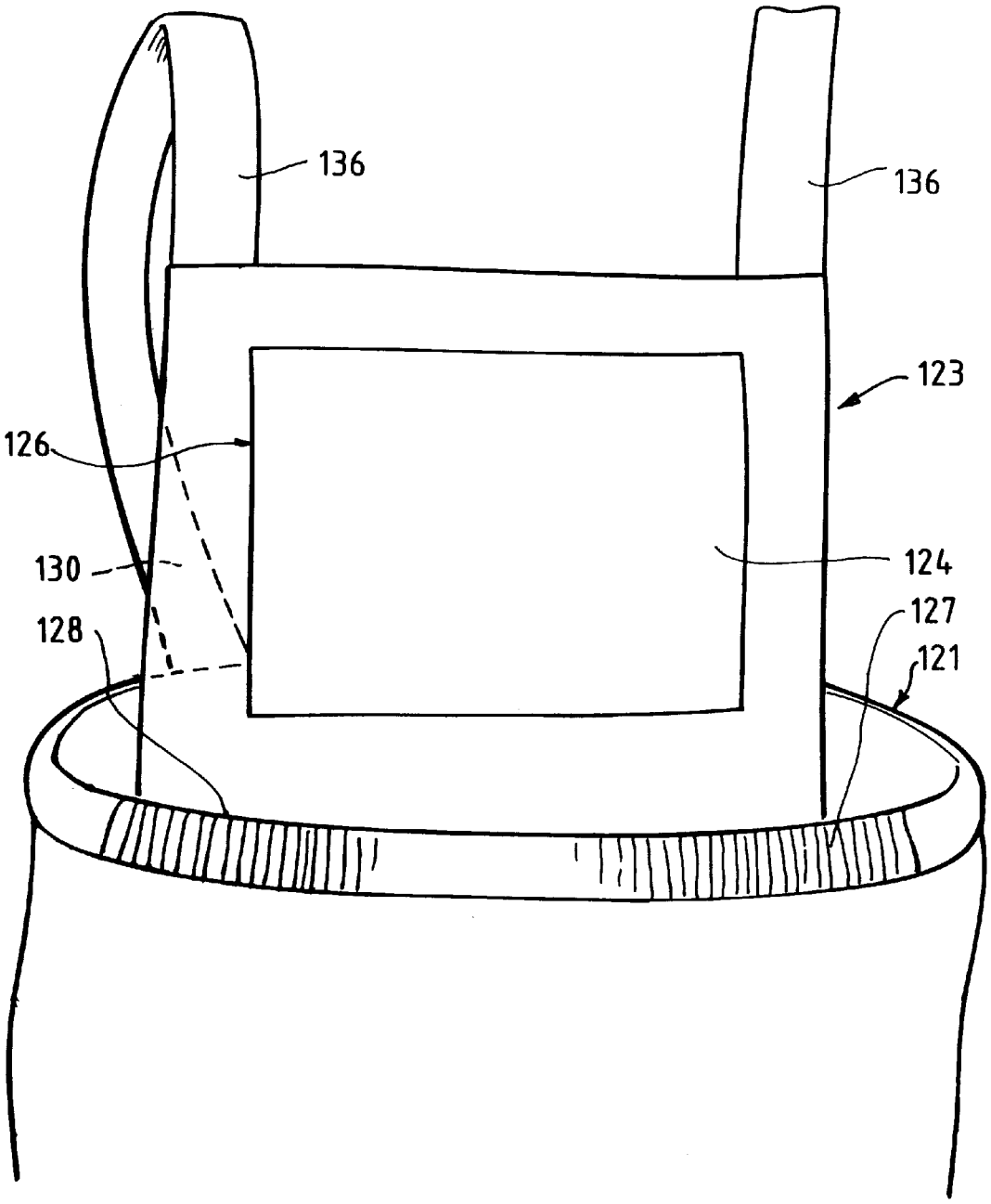
FIG. 4 is a perspective view of a first alternative embodiment of the present invention.

Although FIGS. 1–3 show one preferred embodiment of the present invention, variations and alternatives are also within the scope of the present invention. For example FIG. 4 shows garment 121 with a bib 123 extending upwardly from the waistband 127 thereof. The bib 123 has straps 136 used for securing bib 123 to the rider's torso (not shown). The bib provides additional protection to the front of the rider's jersey or tunic, an area which may become soiled, for example, if the rider leans forward against the mane of the horse during grooming or other activities.

Bib 123 has also been provided with an oversized pocket 124 specially suited for carrying riding equipment, such as riding gloves or glasses. Pocket 124 has a reclosable side edge 126 and is preferably about 9 inches wide and 6 inches long. Bib 123 has a bottom edge 128 secured to waistband 127 at the front and a pair of strap ends 130 secured at the back of waistband 127. The bib 123 can be either permanently attached to waistband 127 or removable therefrom, in which case the bib and the strap ends 130 would be attached to the waistband with buttons, snaps, or other temporary fastening devices.

Figure 5:
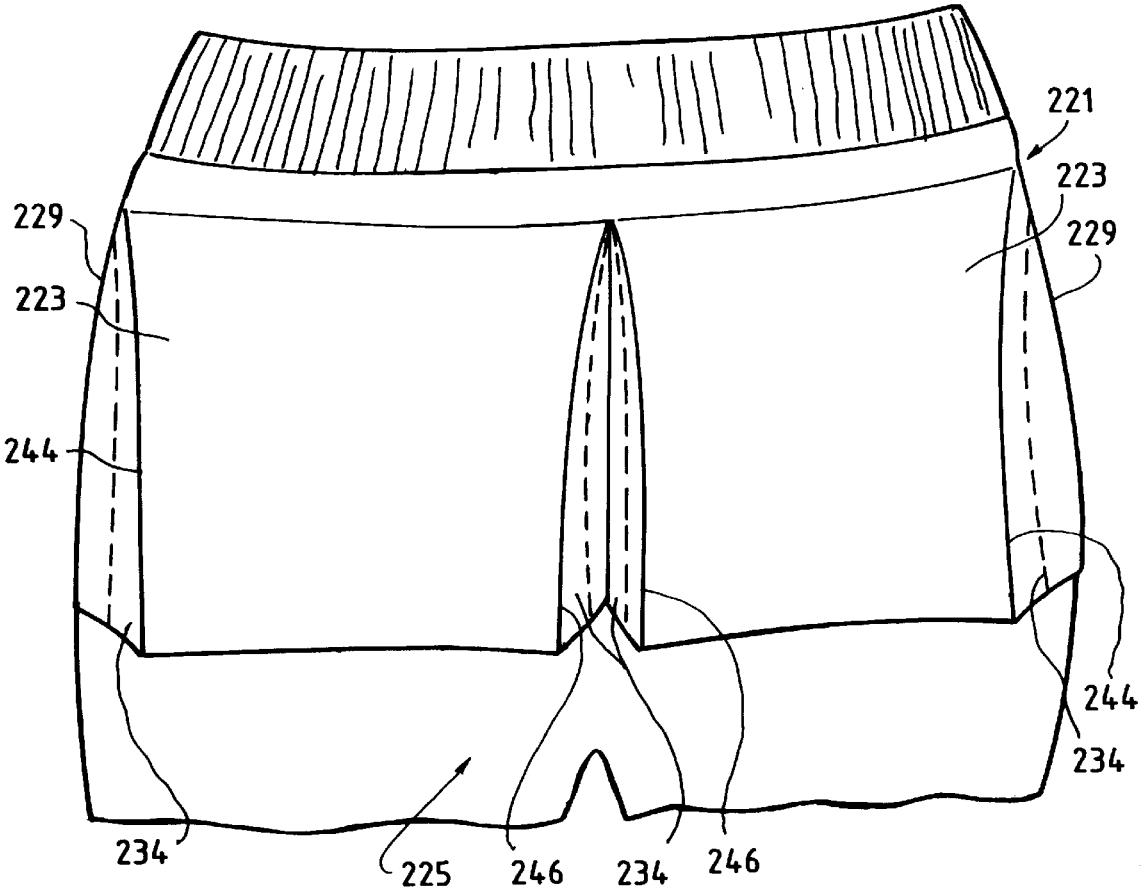
FIG. 5 is a perspective view of a second alternative embodiment or the present invention.

FIG. 5 shows a second, alternative embodiment, where instead of a single pocket as discussed in the previous embodiment, garment 221 includes two pockets 223, each of which is suitably sized for grooming and mane braiding tools. In this embodiment, each pocket 223 has an outer side 244 coincident with a corresponding side seam 229. Inner sides 246 of respective pockets 223 oppose each other in the middle of the front portion 225 of garment 221. Each pocket has a length ranging from about 6 inches to about 8 inches, a length of about 5 inches to about 7 inches, and pleats or gussets 234 to give the pockets 223 a depth of about 2 inches to about 4 inches. Again, the dimensions can be varied so long as the contained space defined by the pocket edges and sides easily accommodates most mane-brading and other grooming tools without stressing the garment material or jabbing into the wearer of the garment or the horse.

In addition to the advantages apparent from the foregoing description, the garment according to the present invention can be easily put on or removed, even when the rider is wearing English-riding boots.

As a further advantage, the rider can wear the garment while mounted on the horse without generating uncomfortable chafing on the insides of the legs.

As a still further advantage, the garment has a pocket especially sized to hold the somewhat bulky grooming and mane braiding tools. Such tools are often needed while the rider is seated atop the horse and therefore can be readily accessed from the pocket.

The foregoing pocket has the additional advantage of being located close to the waistband of the garment so that the contents of the pocket can be accessed even when the rider is crouched or seated in the saddle atop the horse.

Yet another advantage of the garment is that it is lightweight, breathable, and yet has reinforcing material at the insides of the legs where premature abrasion is most likely to occur. As such, the garment will last a long time and yet not be bulky to wear.

The present invention may be embodied in still other specific forms which skill or fancy may suggest, without departing from the spirit or essential attributes thereof. Accordingly, the above-described embodiments are to be considered in all respects as exemplary only and not restrictive, with the scope of the invention being indicated by the appended claims.

What is claimed is:

1. A protective garment to be worn over English-style, horse-riding breeches, the garment comprising:

a waistband to be worn at the rider's waist;

a pair of legs having upper portions connected at the waistband, the legs having respective inner sides which generally contact the flanks of the horse during riding, and outer sides opposite the inner sides, the legs extending downwardly to terminate in bottoms;

at least one pocket defined in the upper portions, the at least one pocket having a top edge immediately below the waistband and defining an enclosed space sufficient for mane-braiding tools, the pocket having a substantially horizontal, reclosable opening positioned relative to the waistband to be accessible when the wearer of the garment is mounted on the horse, the inner sides of the legs being formed of substantially uniform material to avoid chafing the rider as a result of contact between the rider's legs and the flanks of the horse;

a patch of strengthening material secured to the inner side of each of the legs at medial locations between the upper portions and the bottoms; and a reclosable slit in the outer side of each of the legs, the slits extending upwardly from the bottoms a distance of at least 24 inches, whereby such distance is sufficient to pass English-style riding boots therethrough.

2. The garment of claim 1, wherein the outer sides have side seams defined therein, and wherein the pocket extends substantially between the side seams.

3. The garment of claim 2, wherein the slits are located at the side seams, and further comprising a zipper secured along the slit for selectively opening and closing the slits.

4. The garment of claim 1, further comprising at least two of the pockets.

5. The garment of claim 1, wherein the inner portions are formed without inseams which would otherwise chafe against the rider.

6. The garment of claim 1 sewn from a material which is breathable and lightweight.

7. The garment of claim 6, wherein the material is water resistant.

8. The garment of claim 1, wherein the legs are lined with thermally insulating material.

9. The garment of claim 8, wherein the thermally insulating material comprises fleece.

10. The garment of claim 1, wherein the medial locations correspond to the inner sides of the knees of the rider.

11. The garment of claim 1, wherein the waistband and upper portions define a reclosable opening for facilitating donning and doffing the garment.

12. The garment of claim 1, further comprising stirrups secured to the bottoms of the legs, the stirrups extending from the inner sides to the outer sides forward of the respective slits.

13. The garment of claim 1, further comprising:

a bib extending upwardly from the waistband; and means for securing the bib to the rider's torso.

14. A garment for horse-riding comprising:

a waistband to be worn at the rider's waist;

a pair of legs having upper portions connected at the waistband, the legs having respective inner sides which generally contact the flanks of the horse during riding, and outer sides opposite the inner sides, the outer sides having side seams defined therein, the legs extending downwardly to terminate in bottoms;

at least one pocket defined in the upper portions, the at least one pocket having a top edge immediately below the waistband and extending substantially between the side seams of the outer sides to define an enclosed space sufficient for mane-braiding tools, the pocket having a substantially horizontal, reclosable opening positioned relative to the waistband to be accessible when the wearer of the garment is mounted on the horse, the inner sides of the legs being formed of substantially uniform material to avoid chafing the rider as a result of contact between the rider's legs and the flanks of the horse;

a patch of strengthening material secured to the inner side of each of the legs at locations adjacent to the inner sides of the rider's knees; and a reclosable slit in the outer side of each of the legs, the slits extending upwardly from the bottoms a distance not less than about 24", whereby the slit is sufficiently long to pass English-style riding boots therethrough;

wherein the garment is sewn from a water-resistant, breathable, lightweight material.

15. A protective garment to be worn over English-style, horse-riding breeches, the garment comprising:

a waistband to be worn at the rider's waist;

a pair of legs having upper portions connected at the waistband, the legs having respective inner sides which generally contact the flanks of the horse during riding, and outer sides opposite the inner sides, the outer sides having side seams defined therein, the legs extending downwardly to terminate in bottoms;

at least one pocket defined in the upper portions, the at least one pocket having a top edge immediately below the waistband and extending substantially between the side seams of the outer sides to define an enclosed space sufficient for mane-braiding tools, the pocket having a substantially horizontal, reclosable opening positioned relative to the waistband to be accessible when the wearer of the garment is mounted on the horse, the at least one pocket having a bottom edge secured relative to the upper portions of the legs to prevent movement of the pocket independent of the upper portions, the inner sides of the legs being formed of substantially uniform material to avoid chafing the rider as a result of contact between the rider's legs and the flanks of the horse; and a reclosable slit in the outer side of each of the legs, the slits extending upwardly from the bottoms a distance sufficient to pass English-style riding boots therethrough.

16. The garment of claim 15, further comprising a patch of strengthening material secured to the inner sides of each of the legs at locations adjacent to the inner sides of the rider's knees.

17. A protective garment to be worn over English-style, horse-riding breeches, the garment comprising:

a waistband to be worn at the rider's waist;

a pair of legs having upper portions connected at the waistband, the legs having respective inner sides which generally contact the flanks of the horse during riding, and outer sides opposite the inner sides, the outer sides having side seams defined therein, the legs extending downwardly to terminate in bottoms;

at least one pocket defined in the upper portions, the at least one pocket having a top edge immediately below the waistband and extending substantially between the side seams of the outer sides to define an enclosed space sufficient for mane-braiding tools, the pocket having a substantially horizontal, reclosable opening positioned relative to the waistband to be accessible when the wearer of the garment is mounted on the horse, the inner sides of the legs being formed of substantially uniform material to avoid chafing the rider as a result of contact between the rider's legs and the flanks of the horse; and a reclosable slit in the outer side of each of the legs, the slits extending upwardly from the bottoms a distance sufficient to pass English-style riding boots therethrough;

wherein the slits are located at the side seams, are at least about 24 inches long, and further comprising a zipper secured along the slit for selectively opening and closing the slits.

18. An overgarment for protecting English-style riding breeches, the overgarment comprising:

a waistband to be worn at the rider's waist;

a pair of legs having upper portions connected at the waist band, the legs having respective inner sides made of nylon material, the nylon material having an inner surface that is adapted for contact with the riding breeches and an outer surface that is adapted for general contact with the flanks of the horse during riding, whereby the nylon material defines an intermediate, lightweight layer protecting the breeches from direct contact with the flanks, the legs having respective outer sides opposite the inner sides, the legs extending downwardly to terminate in bottoms;

a patch of strengthening materials secured to the inner side of each of the legs at medial locations between the upper portions and the bottoms; and a reclosable slit in the outer side of the legs, the slits having respective upper ends, the slits extending from said respective upper ends to the bottoms of the respective legs.

19. The overgarment of claim 18, wherein the legs include non-tapered leg portions extending along the legs substantially from the bottoms to the upper ends of the slits.

20. An outfit for an English-style horse rider, the outfit comprising:

riding breeches sized to be fitted to the rider's legs;

a protective garment worn over and substantially covering the riding breeches, the garment including:

a waistband to be worn at the rider's waist;

a pair of legs having upper portions connected at the waistband, the legs having respective inner sides which generally contact the flanks of the horse during riding, and outer sides opposite the inner sides, the legs extending downwardly to terminate in bottoms;

at least one pocket defined in the upper portions, the at least one pocket having a top edge immediately below the waistband and defining an enclosed space sufficient for mane-braiding tools, the at least one pocket having a bottom edge secured relative to the upper portions of the legs to prevent movement of the pocket independent of the upper portions, the pocket having a substantially horizontal, reclosable opening positioned relative to the waistband to be accessible when the wearer of the garment is mounted on the horse, the inner sides of the legs being formed of substantially uniform material to avoid chafing the rider as a result of contact between the rider's legs and the flanks of the horse;

a patch of strengthening material secured to the inner side of each of the legs at medial locations between the upper portions and the bottoms; and a reclosable slit in the outer side of each of the legs, the slits extending upwardly from the bottoms a distance sufficient to pass English-style riding boots therethrough.

* * * * *